US008186728B2

(12) United States Patent
Kopylov

(10) Patent No.: US 8,186,728 B2
(45) Date of Patent: May 29, 2012

(54) DRAW LATCH WITH SAFETY CATCH

(76) Inventor: Eduard Kopylov, Aurora, CO (US)

( * ) Notice: Subject to any disclaimer, the term of this patent is extended or adjusted under 35 U.S.C. 154(b) by 332 days.

(21) Appl. No.: 12/807,869

(22) Filed: Sep. 9, 2009

(65) Prior Publication Data

US 2011/0068588 A1 Mar. 24, 2011

(51) Int. Cl.
*E05C 19/12* (2006.01)
*E05C 19/14* (2006.01)

(52) U.S. Cl. ..... 292/113; 292/247; 292/DIG. 49

(58) Field of Classification Search ..... 292/210, 292/DIG. 31, DIG. 49, 113, 200, 247, 150, 292/163, 256.69, DIG. 63; 24/71 R, 71 T, 24/71 A, 68 T, 68 SK, 68 CD, 71 SK, 909, 24/68 D; 70/73, 76
See application file for complete search history.

(56) References Cited

U.S. PATENT DOCUMENTS

| | | | | | |
|---|---|---|---|---|---|
| 1,956,388 | A * | 4/1934 | Loeser | 70/416 |
| 2,951,722 | A * | 9/1960 | Swanson | 292/247 |
| 3,070,396 | A * | 12/1962 | Swanson | 292/247 |
| 3,178,211 | A * | 4/1965 | Honroth | 292/256.69 |
| 3,237,978 | A * | 3/1966 | Swanson | 292/113 |
| 3,339,961 | A * | 9/1967 | Schaefer | 292/256.69 |
| 3,519,298 | A * | 7/1970 | Gley et al. | 292/113 |
| 3,602,723 | A | 8/1971 | Swanson | |
| 3,670,371 | A * | 6/1972 | Swanson | 24/68 T |
| 3,831,224 | A * | 8/1974 | MacMaster et al. | 24/68 T |
| 3,936,082 | A * | 2/1976 | Swanson | 292/113 |
| 4,206,939 | A * | 6/1980 | Rowley, II | 292/263 |
| 4,243,255 | A * | 1/1981 | Hornak | 292/113 |
| 4,307,906 | A | 12/1981 | Schenk | |
| 4,352,513 | A | 10/1982 | Gunther | |
| 5,002,002 | A * | 3/1991 | Awalt, Jr. | 114/210 |
| 5,165,148 | A * | 11/1992 | Fleischer et al. | 24/494 |
| 5,445,422 | A | 8/1995 | Weinerman | |
| 5,452,926 | A * | 9/1995 | Takimoto | 292/113 |
| 5,461,892 | A * | 10/1995 | Hsieh | 70/73 |
| 5,462,318 | A * | 10/1995 | Cooke | 292/200 |
| 5,667,261 | A * | 9/1997 | Weinerman et al. | 292/247 |
| 6,282,758 | B1 * | 9/2001 | Lin | 24/71 SK |
| 6,374,465 | B1 * | 4/2002 | Dykstra | 24/68 T |
| 6,840,551 | B2 | 1/2005 | Evans | |
| 2006/0076785 | A1 * | 4/2006 | Eriksson | 292/247 |

* cited by examiner

*Primary Examiner* — Carlos Lugo
*Assistant Examiner* — Alyson M Merlino

(57) ABSTRACT

A draw latch with a safely catch for fastening two members, where the latch comprises a base attached to one of the two members, a lever pivotally connected to the base for movement between closed and open positions, a draw bar pivotally connected at one end with the lever providing toggle action upon the latch lever closing and another end of the draw bar is for engagement with a draw plate attached to the other of the two members. The safety catch comprises a safety catch bolt with thumb knob, with the colt biased into a locked position by a compression spring to prevent the latch from opening. The safety catch can be placed into an open position by pushing the knob, so the safety catch bolt will disengage from a sidewall of the lever, allowing the lever to be lifted to open the latch.

1 Claim, 5 Drawing Sheets

(VIEW A-A, unlocked, lever lifted)

(VIEW A-A, locked position)

(VIEW A-A, unlocked position)

DRAW LATCH WITH SAFETY CATCH

CROSS-REFERENCE TO RELATED APPLICATIONS

Not Applicable

FEDERALLY SPONSORED RESEARCH

Not Applicable

SEQUENCE LISTING OF PROGRAM

Not Applicable

BACKGROUND OF INVENTION

1. Field of Invention

This invention relates generally to heavy duty, toggle type draw latches for connecting two relatively movable members.

Some of such latches, existing on the market, are equipped with safety locking means which are such like provisions for padlock installation, hook type catches, locks requiring keys, spring hooks, rotational locking cams are either expensive to manufacturer or not reliable in heavy duty applications.

The is need for a draw latch with simple, durable, reliable secondary catch with exposed engagement which will be able to operate reliably in heavy duty applications.

2. Prior Art

The Catch with Antirelease Latch by Gunnar E. Swanson in U.S. Pat. No. 3,602,723 Proposes hook type safety catch which engagement concealed within device, such arrangement does not offer positive control of the safety latch engagement and hook type catch is not reliable in heavy duty applications The Adjustable Toggle Latch and Safety Catch offered by Schenk in U.S. Pat. No. 4,307,906 comprises the hook formed flat spring as the safety catch mounted on the latch and engaging the latch lever. The exposed spring element of this safety locking arrangement is prone to bending in heavy duty application.

The Toggle Latch with Spring Catch presented by Conrad Gunther in U.S. Pat. No. 4,352,513 comprises spring type safety catch which is prone to bending and does not offer observable engagement.

The Handle Operated Draw Latch with Safety Catch disclosed by Weinerman et al U.S. Pat. No. 5,445,422 comprises hook type safety catch with too many complicated parts increasing cost of manufacturing and reducing reliability of performance.

The Over-center Latch disclosed by Norman Evans in U.S. Pat. No. 6,840,551 comprises safety catch which is pivotally movable in and out of engaged Position offers observable engagement, however, it requires significant angular rotation and rotating Catch Member is a cantilever extending from the pivotal point and is prone to bend and jam.

3. Objects and Advantages

Accordingly, besides the objects and advantages of the Toggle Latch described in my patent, several objects and advantages of the present invention are:

a. To provide a Draw Latch with simple, low manufacturing cost Safety Catch.
b. The Safety Catch shall be reliable and durable to withstand strong unlocking forces in heavy duty applications.
c. The Safety Catch shall have positive, observable engagement.
d. Action of the Safety catch shall be ergonomically convenient

SUMMARY

The device of the present invention overcomes the above-mentioned disadvantages and drawbacks that are characteristic of these aforementioned designs. More particularly, a preferred embodiment of the present invention a draw toggle latch with the safety catch comprising spring loaded bolt with a thumb knob, where said bolt is linearly movable in locked and unlocked positions in direction substantially parallel to the Latch lever pivotal axis.

DRAWINGS-FIGURES

DRAWINGS

Reference Numerals

11—Fastened member
12—Fastened member
13—Inventive Draw Latch with the Safety Catch
14—Draw Plate with hook style edge
15—Latch loop style Draw Bar
16—Latch Base
17—Latch Lever
17A—Latch Lever Web Wall
17B—Latch Lever Latch Bolt Supporting Side Wall
17C—Latch Lever Safety Catch Locking Side Wall
18—Latch lever Pivotal Connection Fastener
19—Loop type Draw bar Pivotal connection
20—Latch/draw plate Fastener
21—Latch safety catch Thumb Knob
22—Latch safety catch Bolt
23—Latch base Tab for engagement with the safety catch
24—Slide Slot in the latch lever for the safety catch thumb knob
25—Latch safety catch Bolt Support Bracket attached to the latch lever
26—Safety catch bolt Compression Spring
27—Latch base tab safety catch bolt Engagement Hole
28—Latch lever safety catch bolt Engagement Hole
29—Hole in the latch lever side wall to support the safety catch bolt
30—Latch Adjustable length Draw Bar with Hook style engaging end
31—Draw bar Pivotal Shaft
32—Draw bar Threaded Connection to the pivotal shaft
33—Pivotal shaft Fastener
34—Draw Plate with slot for draw bar engagement

DETAILED DISCLOSURE OF PREFERRED EMBODIMENTS

Although specific features of the invention are shown in some drawings and not others, this is for convenience only as each feature may be combined with any or all of other features in accordance with the invention.

While preferred illustrative embodiments of the invention are described above, it will be apparent to those skilled in the art that various changes and modifications may be made without departing from the invention.

The appended claims are intended to cover all changes within the spirit of the invention. A preferred embodiment of the inventive draw latch is illustrated in FIGS. 1-5.

Figure 1:
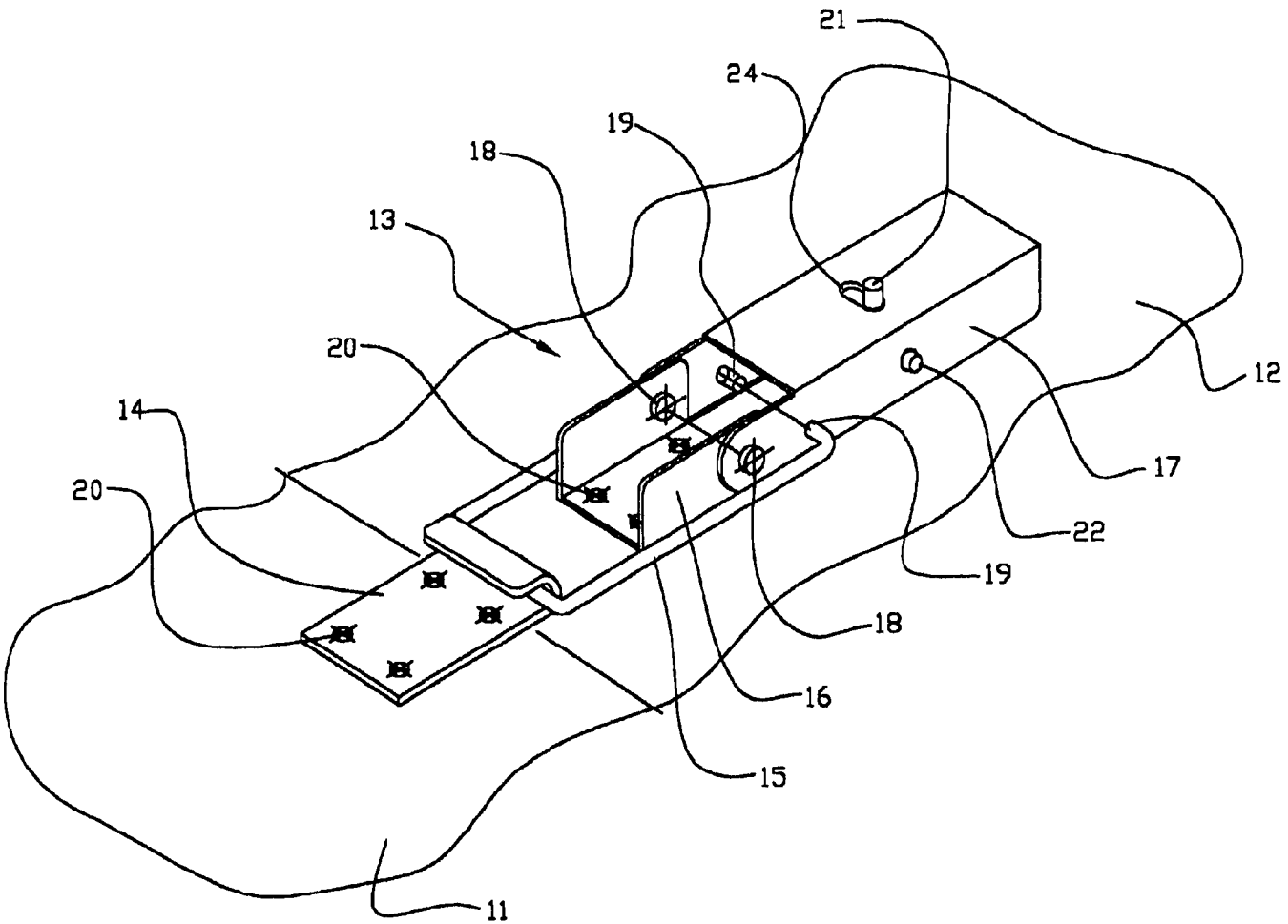
FIG. 1 Shows isometric view of the inventive latch in locked position with the safety catch in locked position.

Referring now to FIG. 1, which is an isometric view of the inventive draw latch 13 fastening together two members 11 and 12. The latch is shown in closed position where the loop style draw bar 15 pulling the hook style edge of the draw plate 14 coupled to the member 11 and the base 16 of the latch is coupled to the member 12 by fasteners 20. Additionally, the latch comprised the lever 17 pivotally connected to said base 16 by two pivotal connection fasteners 18 arranged in coaxial way. One end of the draw bar 15 has pivotal connections 19 on both side walls of the latch lever 17 and arranged in coaxial way. Pivotal axis of said pivotal connections 19 is located at closer distance to the surface of said member 12 than pivotal axis of said lever fasteners 18 to provide toggle action for the latch.

Some elements of the inventive safety catch are shown on this drawing:

the safety catch bolt 22 protruding through the side wall of the latch lever 17 the thumb knob 21 of the safety bolt is shown in the slide slot 24. Fasteners 20 connect the draw plate 14 to fastening member 11 and the latch base 17 to the fastening member 12.

Additional elements and the method of operation of the safety catch will be presented in the further drawings.

Figure 2:
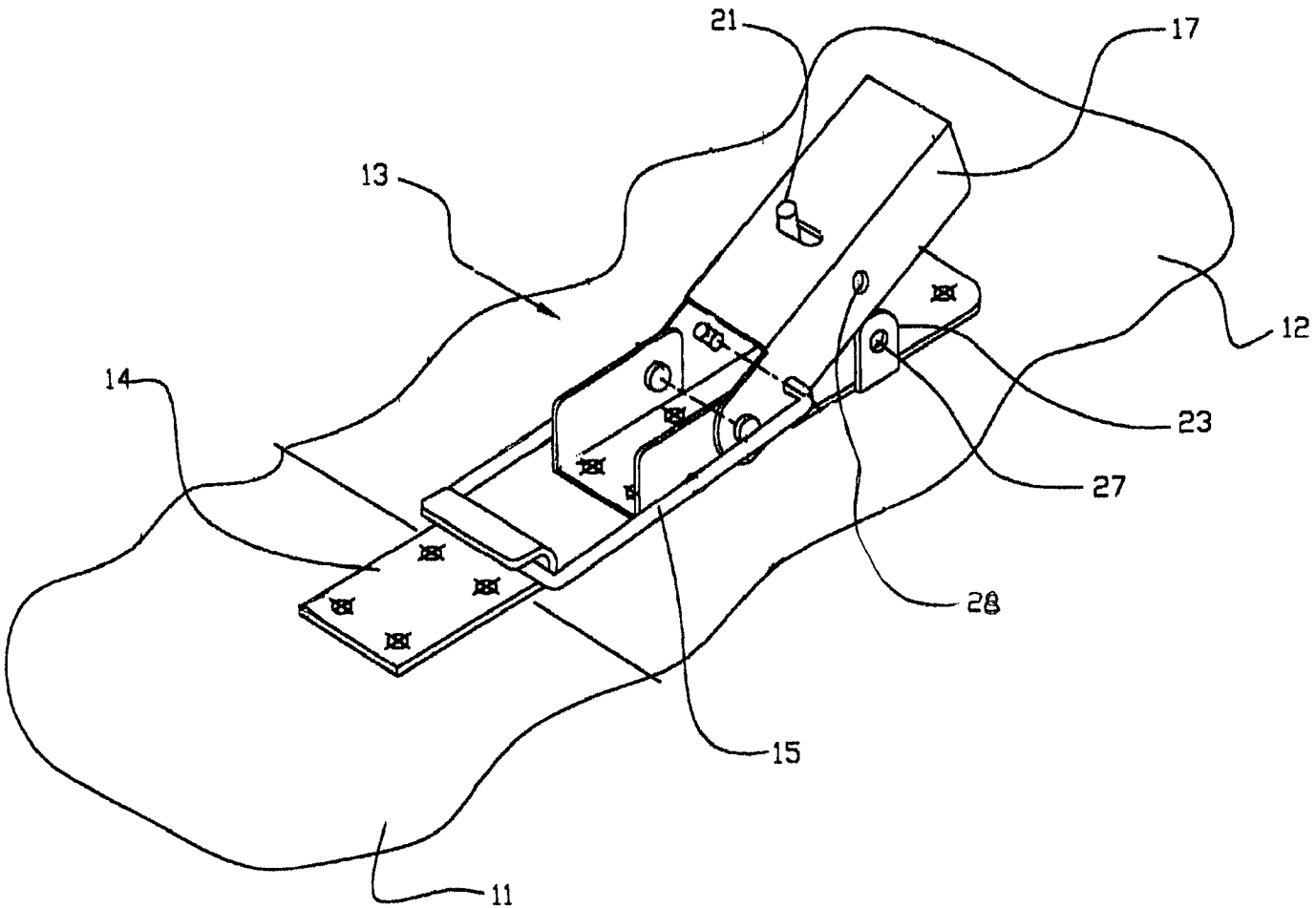
FIG. 2 Shows isometric view of the inventive latch with lifted lever and with safety catch in unlocked position.

The FIG. 2 shows the same draw latch 13 fastening together two members 11 and 12, as described above, but in unlocked position.

Said safety latch bolt thumb knob 21 has been moved to open position and the safety catch bolt has been disengaged from the hole 28 located on the side wall of latch lever 17 and from the hole 27 of the latch base tab 23 to allow the latch lever 17 to be lifted to release the draw bar 15 from the draw plate 14.

Figure 3:
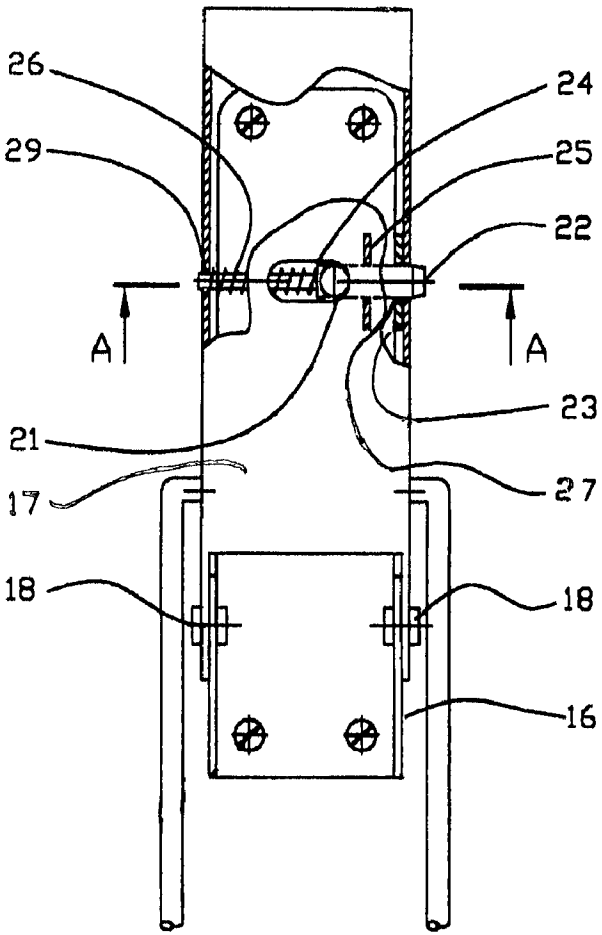
FIG. 3 Shows top view of the inventive latch in locked position.

The partial plan view of the inventive draw latch is presented on FIG. 3. This drawing shows all elements of the safety catch: the latch safety catch bolt 22 supported by the side wall of the latch lever 17 (with hole 29) and the support bracket 25 attached to the latch lever, the thumb knob 21 attached to the safety catch bolt 22 and protruding though the slot 24 on the latch lever 17, the compression spring 26 installed on said bolt 22, the latch base tab 23 with hole 27 for engagement with the safety latch bolt 22. Said above the bolt 22 supports are arranged to allow linear movement of the bolt 22 between locked and unlocked positions. The orientation of the safety catch bolt 22 is substantially parallel to the pivotal axis of the latch lever (which is a rotational center line of the fasteners 18).

Figure 4C:
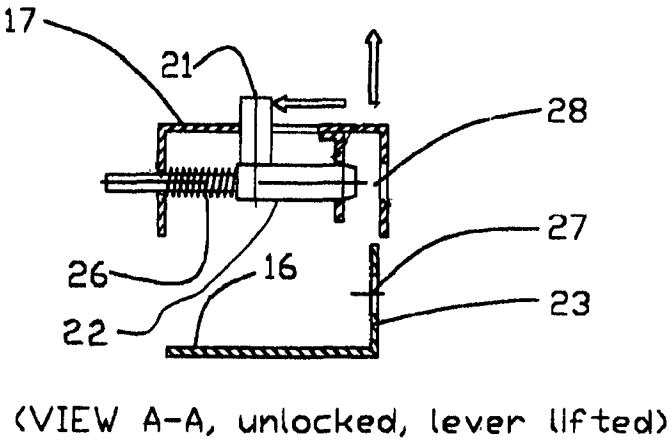
FIG. 4C Shows section A-A of the inventive latch showing the safety catch in unlocked position and the latch lever lifted.
Figure 4A:
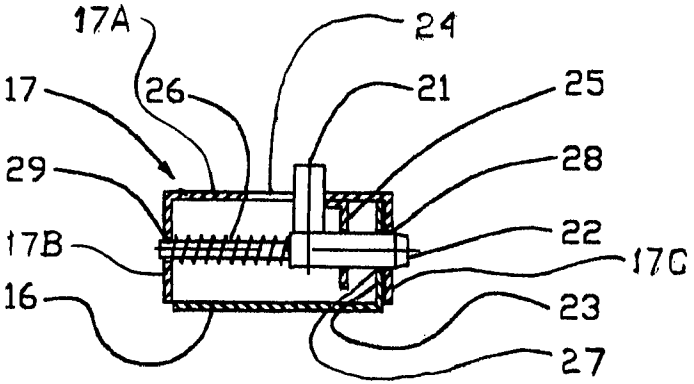
FIG. 4A Shows section A-A of the inventive latch showing the safety catch in locked position.
Figure 4B:
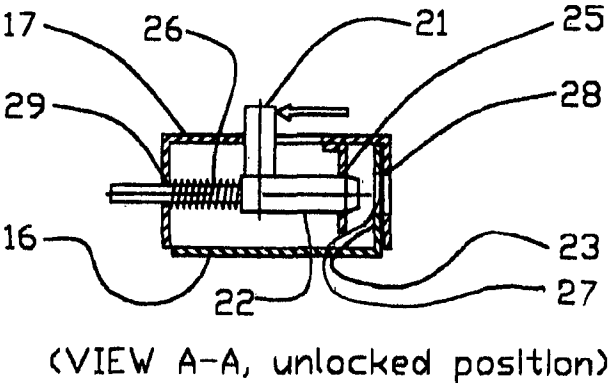
FIG. 4B Shows section A-A of the inventive latch showing the safety catch in unlocked position.

Section A-A on the drawing FIG. 3 allows more detailed description of the inventive safety catch on the following FIG. 4A through FIG. 4C.

FIG. 4A shows Section A-A view of the inventive draw latch with the emphasis in the safety catch arrangement. The section A-A shows the latch base 16 and the latch lever 17 in a closed position, the safety catch in locked position with the safety catch bolt 22 engaging said latch base tab 23 and said latch lever hole 28 and protruding through this hole to insure visual acknowledgement of engagement of said safety catch in the locked position. It is obvious for those skilled in the art that said above visual acknowledgement of engagement of the secondary latch is absolutely reliable because if the latch lever is not moved to a fully closed position the hole 27 of the latch base tab 23 and hole 28 of the lever side wall 17C will not align, so, said safety catch bolt 22 will not be able to slide through said hole 27 and eventually through the hole 28.

Said latch lever 17 has essentially a channel shape with two side walls (flanges) and a web wall 17A connecting said side walls 17B and 17C.

A compression spring 26 coaxially mounted on the safety catch bolt 22 forcing said bolt 22 to remain in locked position.

As can be seen on the drawing, the safety catch bolt 22 is supported by a support bracket 25 attached to interior side of the latch lever web wall 17A and a hole 29 in the side wall 17B of the latch lever 17.

Said latch base tab 23 assumes lockable position between said support bracket 25 and side wall 17C of the latch lever 17. The drawing shows the thumb knob 21 of the bolt 22 is residing at the end of the slot 24 which is located in the top wall of the lever 17 allowing movement of the bolt 22 between locked and unlocked position.

The drawing shows that said safety catch bolt 22 can experience, practically, only shear stress in attempt to lift the latch lever 17, so this bolt design can withstand significant force and straight action of the compression spring 26 makes said bolt 22 engagement forceful and reliable, so, the whole safety catch concept is very simple and inexpensive to manufacture.

FIG. 4B shows Section A-A view of the safety catch in unlocked position with the latch lever 17 and the latch base 16 still in closed position. Said safety catch bolt has been disengaged from the hole 28 of the latch lever 17 and from the hole 27 of the latch base tab 23, the spring 26 is compressed, the end of the bolt 22 supported by the hole 29 is more extended from the side wall of the latch lever 17. The thumb knob 21 is in unlocked position being temporary supported in this position by an operator thumb to allow said lever 17 to open (see FIG. 4C).

FIG. 4C shows Section A-A view of the safety catch in unlocked position with said latch lever 17 being lifted from the base 16. The bolt 22 with the thumb knob 21 is held in disengaged position from the hole 27 of the base tab 23 and hole 28 of the lever 17 and the spring 26 is being held compressed.

Figure 5:
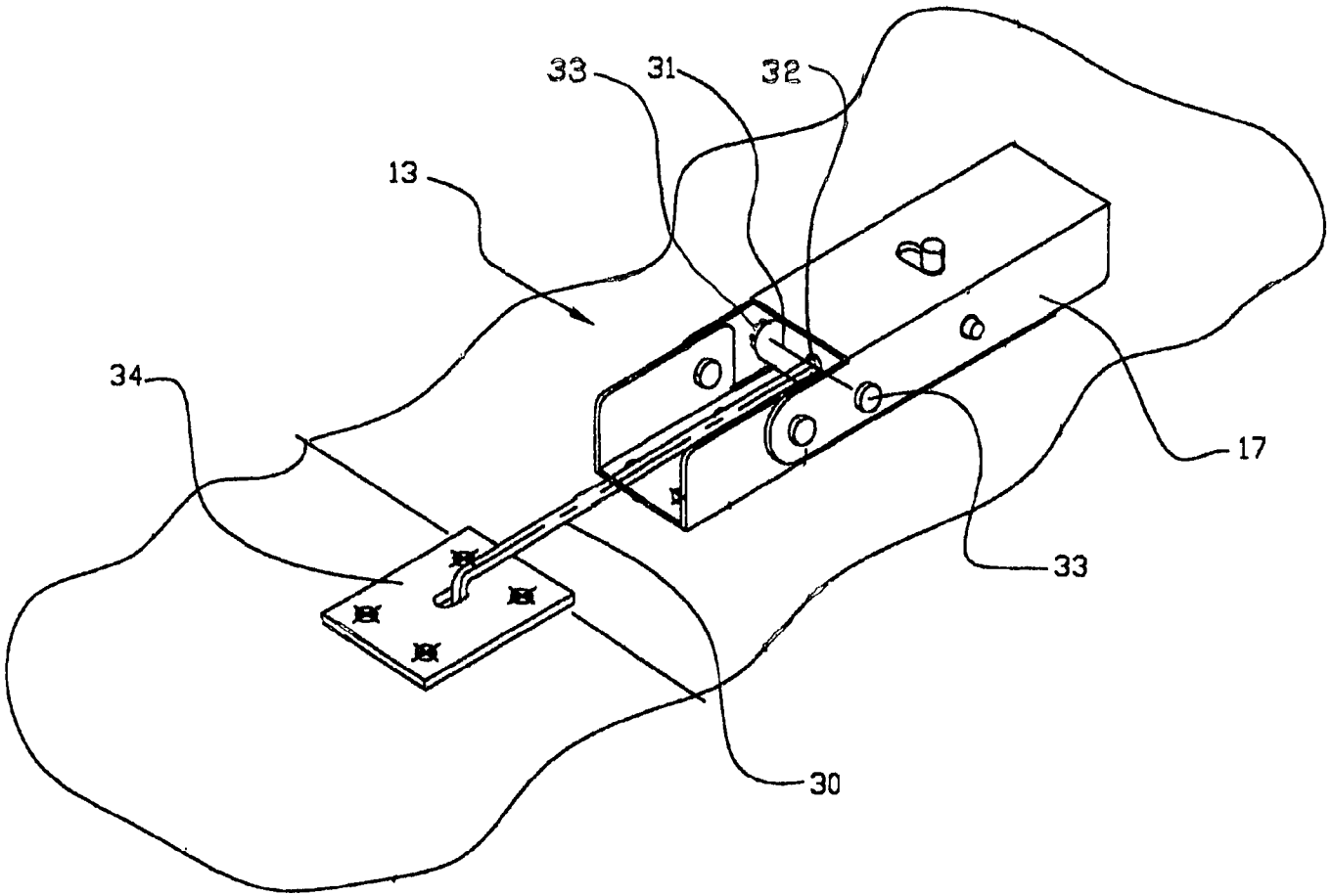
FIG. 5 Shows isometric view of the inventive latch equipped with adjustable length draw bar with hook style engaging end.

FIG. 5 presents isometric view of the inventive draw latch 13 equipped with an adjustable length draw bar 30 with hook style engaging end in locked position. Another end of said draw bar is attached to the pivotal shaft 31 by threaded connection 32 comprising matching male thread on said draw bar 30 and female thread on said pivotal shaft 31. Said draw bar pivotal shaft 31 is pivotally attached to the draw latch lever 17 by two substantially coaxial oriented pivotal shaft fasteners 33. The hook end of the draw bar 30 is shown being engaged with the draw plate 34. This latch is also equipped with the safety catch presented and described above.

Some elements of the latch described above, such as draw bars 15 and 30, draw plates 14 and 34, methods of adjustments of a draw bar to accommodate dimensional variations and general draw latch method of operation being of the usual conventional design, old in the art, and well known in structure and methods of operation to those skilled in the art, they are therefore simply indicated, and the details of structure and operation of them are omitted.

I claim:

1. A draw toggle latch comprising a latch base, a latch lever pivotally connected the latch base, a draw bar pivotally connected to said latch lever wherein said latch lever is pivotally movable between closed and open positions, a safety catch comprising a latch base tab with an engagement hole, a second engagement hole in one side wall of the latch lever, a safety catch bolt with a thumb knob protruding through a slot in a top wall of said latch lever, wherein said slot allows limited linear movement of the safety catch bolt between locking and unlocking positions and said safety catch bolt is supported by an another side wall of said latch lever and a support bracket attached to an interior side of the top wall of the latch lever, and a compression spring, being mounted coaxially on said safety catch bolt, pushes the safety catch bolt to the locked position, wherein orientation of said safety catch bolt linear movement is substantially parallel to a pivotal axis of the latch lever, so when said latch lever is in the closed position, said latch base tab assumes a locking position between the safety catch bolt support bracket and the one side wall of the latch lever wherein said engagement holes of the latch base tab and of the one side wall align to allow said safety catch bolt to slide through these holes to the locking position, holding said latch lever in the closed position and a tip of said safety catch bolt protruding through the second engagement hole to provide a visual acknowledgement of the safety catch engagement and, further, said latch lever can be moved to the open position with the release of the safety catch by pushing said thumb knob to the unlocking position causing disengagement of the safety catch bolt from the second engagement hole of the one side wall of said latch lever and the engagement hole of said latch base tab.

* * * * *